US005602355A

United States Patent [19]

Lipp

[11] Patent Number: 5,602,355

[45] Date of Patent: Feb. 11, 1997

[54] PERCUSSION IMPACT IMPLEMENTS AND METHODS FOR MAKING THE SAME

[75] Inventor: Howard S. Lipp, Torrance, Calif.

[73] Assignee: Main Line Equipment Incorporated, Carson, Calif.

[21] Appl. No.: 322,784

[22] Filed: Oct. 13, 1994

[51] Int. Cl.[6] ..... G10D 13/02

[52] U.S. Cl. ..... 84/422.4; 84/452 R

[58] Field of Search ..... 84/422.4, 452 R, 84/452 P

[56] References Cited

U.S. PATENT DOCUMENTS

| | | | |
|---|---|---|---|
| 3,147,660 | 9/1964 | Brilhart | 84/422.4 |
| 4,040,323 | 8/1977 | Kline | 84/422.4 |
| 4,047,460 | 9/1977 | Fiedler et al. | 84/422.4 |
| 4,114,503 | 9/1978 | Petillo | 84/422.4 |
| 4,300,438 | 11/1981 | Handal | 84/422.4 |
| 4,320,688 | 4/1982 | Donohoe | 84/422.4 |
| 4,355,560 | 10/1982 | Shaffer . | |
| 4,385,544 | 5/1983 | Heiskell | 84/422.4 |
| 4,763,557 | 9/1988 | Donohoe | 84/422.4 |
| 4,768,943 | 9/1988 | Honsa | 425/236 |

*Primary Examiner*—Cassandra C. Spyrou
*Attorney, Agent, or Firm*—Loeb & Loeb LLP

[57] ABSTRACT

A drumstick body and method for fabricating the same, the drumstick body having resin coated fibers and a filler material. The method includes the steps of coating at least one fiber with resin, wrapping a length of the fiber around a roller, placing the length of fiber into a mold, and curing the resin to form a solid drumstick body.

22 Claims, 5 Drawing Sheets

PERCUSSION IMPACT IMPLEMENTS AND METHODS FOR MAKING THE SAME

BACKGROUND OF THE INVENTION

1. Field Of The Invention

This invention relates to percussion impact implements and in particular embodiments to drumsticks and methods of making the same, and particularly to drumsticks fabricated using fibers and resin.

2. The Related Art

Percussive sounds have since ancient times been obtained by striking a flexible membrane with a wooden object. Controlled and more reproducible sounds resulted when the wood object was a straight rod. Hence the development of the modern drumstick. With the passing of time, innovations occurred including a degree of taper at the front end of the stick, the stick being finished off with a tip, and the use of a wood having a modicum of flexibility. A select hickory was the wood of choice.

Prior to World War II, the hickory selected for sticks was of the highest grade and thoroughly seasoned. Shortly after the war, the availability of seasoned top quality hickory deteriorated to a point where the stick makers either closed down periodically or sought out substitute material. None could meet the standards set by seasoned hickory. Warpage, splitting and variation in physical properties was a serious problem.

Wood is essentially cellulose distributed randomly throughout the system held together with a very poor adhesive resin. Both components are highly susceptible to erosion by water, even moisture. Its resistance to failure varies from inch to inch.

Numerous attempts have been made to fabricate drumsticks having improved durability over conventional wooden drumsticks.

U.S. Pat. No. 4,047,460 to Fielder et al. discloses a drumstick fabricated from short fibers embedded in a nylon matrix. The short fibers are randomly oriented, and the drumstick contains approximately 30% by volume fibers and 70% by volume nylon matrix. The drumstick is made in two parts, which are welded together to make the drumstick. The drumstick also contains a hollow bore extending through a substantial portion of the handle length.

U.S. Pat. No. 4,114,503 to Petillo discloses a drumstick containing a core having arms extending outward and an outer shell which fills the space between the core and the arms and extends to the outer surface of the drumstick. The core is constructed of a material having a high tensile and shear strength, such as aluminum. The outer shell is constructed of segments which may be wood such as hickory.

U.S. Pat. No. 3,147,660 to Brilhart discloses a drumstick fabricated from unidirectional fibers and resin and molded through the application of heat and pressure. The drumstick may contain a hollow cavity drilled into the handle portion, into which an acoustical foam material is placed.

Two piece construction as in several of the above patents may make it difficult and/or expensive to obtain drumsticks with minimal variance from stick to stick because of the multiple steps involved to make separate components and accurately attach the components together. Additionally, a stick having multiple parts to attach together, such as a core with arms as in Petillo has a more complex structure than a single piece molded stick. Similarly, drilling a cavity into a stick adds complexity to the process and requires more manufacturing steps than a molding process alone.

It would be desirable to provide a drumstick which is more durable than conventional wooden drumsticks, yet can closely duplicate the weight, feel, and tonal qualities of wooden drumsticks. In addition, it would be desirable to provide drumsticks whose properties do not significantly vary from stick to stick, and which is relatively easy to manufacture. Embodiments of the present invention are directed towards these and other objectives.

SUMMARY OF THE DISCLOSURE

Embodiments of the present invention relate to a drumstick formed of a resin body having a plurality of fibers within the body and a filler material and optional colorant distributed throughout the body.

Further embodiments of the present invention relate to a method for fabricating a drumstick including a step wherein a plurality of fibers are drawn through an adhesive bath to wet the fibers with resin and filler composition and then assembled into a larger fiber bundle. The bundle is then wrapped around a roller. Next, a predetermined amount of the bundle is removed from the roller and mounted on a hook. The bundle is then drawn into a molding robe and cured.

Drumsticks according to embodiments of the present invention possess superior attributes over wooden drumsticks. The matrix of resin and filler, along with the fibers, provide a stick which is stronger than wood and more resistant to failure. In addition, the variance stick to stick in properties such as strength and weight is significantly less than typical conventional drumsticks made of wood.

BRIEF DESCRIPTION OF THE DRAWINGS

Further objects, advantages and features of the present invention will become apparent from the detailed description, below, when read in conjunction with the accompanying drawings (which, for illustrative purposes, are not drawn to scale), where.

DETAILED DESCRIPTION OF PREFERRED EMBODIMENTS

This description contains the best mode for carrying out the present invention and is made for the purpose of illustrating the principles of the invention, and is not to be taken in a limiting sense. The scope of the invention is determined by reference to the appended claims.

Figure 1:
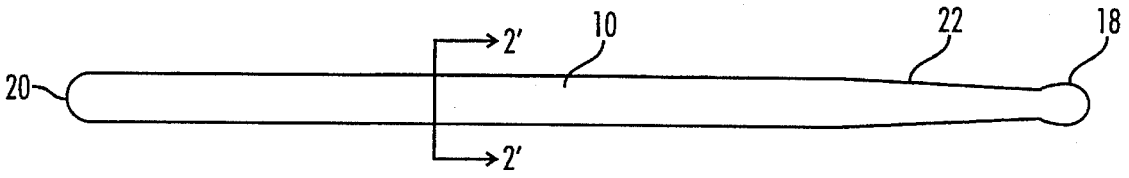
FIG. 1 is a plan view of a drumstick according to a preferred embodiment of the present invention.
Figure 2:
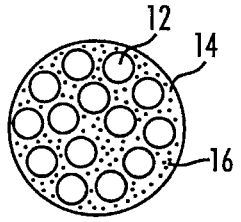
FIG. 2 is a cross sectional view along the line 2'—2' in FIG. 1.

Embodiments of the present invention relate to drumsticks and methods for their manufacture. FIG. 1 shows a plan view of a drumstick 10 having tip 18, butt end 20, and tapered region 22. FIG. 2 shows a cross section along the line 2'—2' of FIG. 1. In cross section, fibers 12, matrix 14, and microspheres 16 can be seen. The fibers and microspheres 16 may be uniformly distributed in the matrix material 14.

A variety of fiber, matrix, and microsphere materials may be used in the fabrication of the drumsticks according to embodiments of the present invention. Fiber materials may include various synthetic and natural fibers. For example, a preferable material is the aramid fiber Kevlar (trademark; available from E. I. DuPont de Nemours), due to its favorable mechanical and decomposition resistance properties. Other fiber materials which could be used include, but are not limited to, other aramids, polyester, polyethylene, carbon graphite, Spectre (trademark; available from Allied Fibers Corp., a subsidiary of Allied Signal), cotton, nylon, and fiberglass. Different fiber materials may be mixed together in order to obtain particular physical properties or to obtain a certain external appearance such as an exotic multicolor grain.

Various matrix materials can also be used, including, but not limited to epoxies and other resin materials. A preferable epoxy resin is Araldite (trademark; available from Ciba/Geigy Corp. ). Other polymeric compositions may also be used.

In preferred embodiments, a filler is mixed into the matrix and used primarily for weight reduction purposes. Such filler may comprise microspheres of suitable material. The microspheres take up volume in the drumstick and weigh less than a comparable volume of matrix material. The microspheres are preferably substantially uniformly distributed in the matrix. The filler materials may be chosen on the basis of weight, volume, strength, tonal quality and whether the microsphere will change size during or after processing. The filler material may also contribute to the rigidity and strength of the drumstick. In preferred embodiments, the microspheres comprise generally spherical bodies having a diameter within the range of about 1 micron to about 5000 microns and made of a suitable material such as ceramic, glass, polymeric materials or the like. While spherical bodies are preferred due to manufacturing efficiencies and consistent reproducability, in other embodiments, bodies of other morphologies may be used as an alternative to spherical bodies.

Preferable microspherical materials which possess suitable properties include volcanic spheres, such as Dicalite (trademark; available from Grefco Inc.); and thermoplastic spheres, such as Expancel (trademark; available from Nobel Industries, Sweden), Ucar (trademark; available from Union Carbide Chemicals), PM6545 (available from PQ Corp.), and Duolite (trademark; available from Pierce & Stevens Corp.). Non-spherically shaped filler materials may also be used either with or in place of the microspheres. Examples of preferred non-spherical materials include wood flour, Silcell (trademark, available from Silbrico Inc.), Dicalite Diatomite (trademark; available from Grefco Inc. ). In addition or as an alternative to the above-discussed fillers, air bubbles may be used as a filler in order to save more weight.

The drumsticks may have shaped tips disposed on the tapered end. Tips may be fabricated from various materials, including, but not limited to nylon, polycarbonate, aramid, polyurethane, wood, and metal. The tips may be bonded to the stick using an adhesive, for example, cyanoacrylate (made by Permabond International or an epoxy. Alternatively, tips may be composed of shaped ends of the sticks themselves, as opposed to be manufactured apart from the sticks and later attached to the sticks.

The sticks may be colored using a pigment or a dye. Potential dyes include organic dyes, metal complex dyes, and phosphorus dyes. One particular pigment which has been used is Orasol (trademark, available from Ciba/Geigy). The sticks may take on various wood grain appearances either with or without colorant.

Marking (model no., manufacturer, etc.) may be provided on the sticks using an epoxy ink, hotstamp foil, laser etch, or hot etch.

Figure 3:
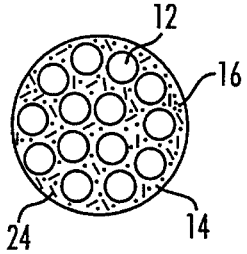
FIG. 3 is a cross sectional view showing a drumstick according to another embodiment of the present invention.

FIG. 3 shows a cross sectional view of a particular embodiment in which short fibers (also called staples) 24 are present in the matrix material 14 along with fibers 12 and microspheres 16. These short fibers 24 may be used to improve certain strength properties of the drumstick. The short fibers 24 may be made from a variety of fiber materials including those discussed above. A preferable choice is an aramid staple.

The following description is an example of a process according to preferred embodiments of the present invention, for fabricating drumsticks using Kevlar fiber as the fiber material. However, as discussed above, other fiber materials may be used as an alternative or in addition to Kevlar fiber. The process is typically performed in a manner so that a plurality of sticks are fabricated at the same time. For clarity much of the following explanation refers to the manufacture of one stick.

Figure 4:
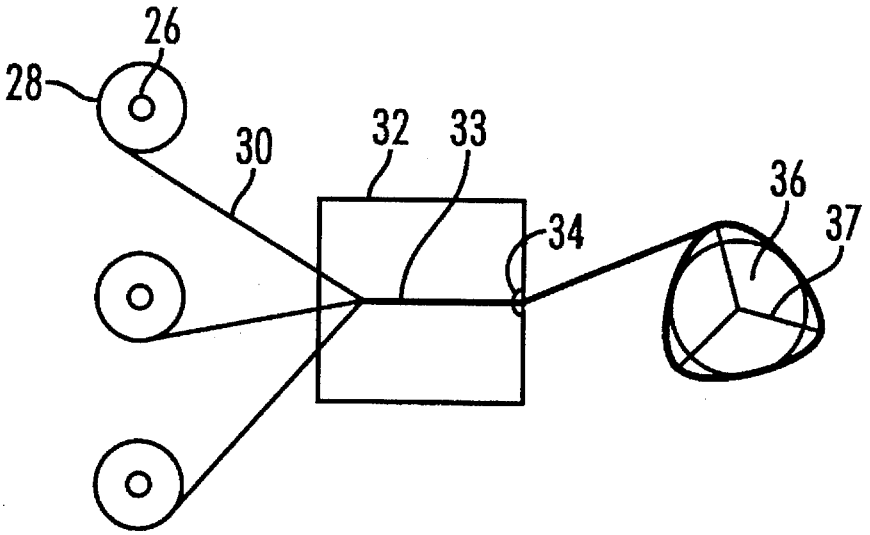
FIG. 4 is a schematic showing the initial steps in manufacturing drumsticks according to certain embodiments of the present invention.
Figure 6A:
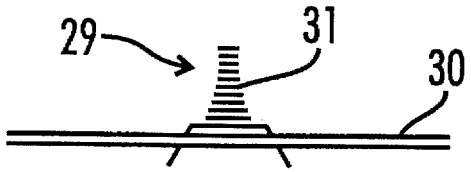
FIGS. 6(*a*) and 6(*b*) are plan views of mechanisms for tensioning the fiber as it is drawn along the processing system, according to certain embodiments of the present invention.
Figure 6B:
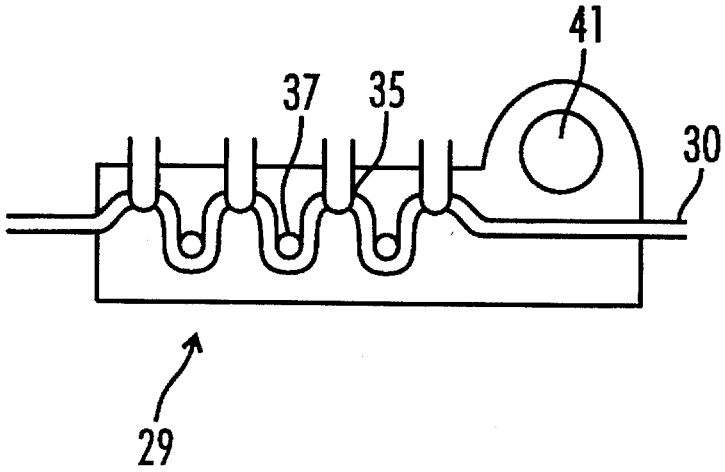

As shown in FIG. 4, rolls 28 of Kevlar fiber are mounted on creels 26 supported on a backboard. Each strand 30 of Kevlar fiber is acted on by a mechanism (such as a draw rolling system) for drawing it along a processing system as shown in the diagram of FIG. 4. The mechanism may contain one or more tensioning devices 29 for controlling the tension on a fiber as it is drawn along the processing system. The spring tensioning device 29 may be comprised of a spring mechanism 31 (FIG. 6(*a*)) or a mechanism comprising moveable openings 35 and/or supports 37 through which the fiber 30 is thread as shown, for example in FIG. 6(*b*). The mechanism 31 has an adjustable control 41 so as to regulate the amount of tension on the fiber 30 as it passes through the mechanism.

The fiber strands 30 are drawn through an adhesive bath 32 and assembled into a larger bundle 33 made up of a suitable number (such as approximately 4–16) of the original strands before the back end of the bath 32. The bath 32 contains a mixture of resin chemicals and microspheres. The strands 30 are thoroughly wetted and coated with the liquid chemicals and microspheres in the bath 32.

The bundle 33 is then drawn though a small opening 34 (for example, either attached to or disposed in the wall of the container holding the bath) to squeeze out excess resin. Next the bundle 33 travels to a rotating disc 36 where a timer or counter system controls the number of turns to be made. The rotating disc 36 supports three posts 37 around which the bundle 33 is wrapped during rotation of the disc. One complete loop around the three posts 37 results in a predefined perimeter length (for example 36 inches).

Figure 5:
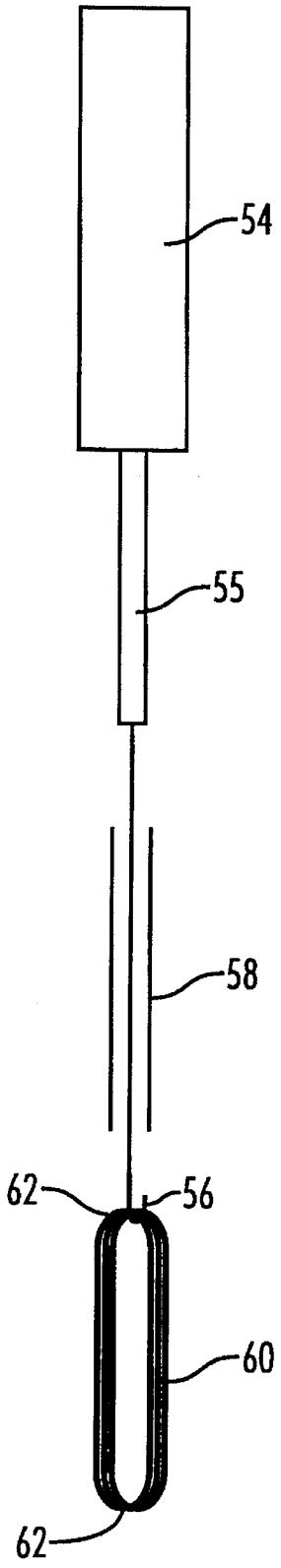
FIG. 5 is a schematic showing equipment used for placing drumsticks into molds prior to curing according to certain embodiments of the present invention.

The number of loops of the bundle 33 to form a drumstick is preferably within the range of about 1–150 loops and varies with each model and size of stick. A suitable number of loops are are removed from the posts 37 of the rotating disc 36 and mounted on a hook 56. The hooked looped bundle 60 is then drawn through a molding tube 58, as shown in FIG. 5. The molding tube 58 may be constructed from suitable materials including metals such as steel and stainless steel. However, further embodiments may employ a variety of other materials for the molding tube 58, for example polymers. A suitable releasing agent may also be used within the molding tube 58. In addition, further embodiments may use a tubular mold which is shaped to provide for tapering or other design features in the mold itself.

The molding tube 58 is opened at both longitudinal ends, and may be sized to be slightly shorter than the length of the looped bundle 60 once it has been pulled through the molding tube 58. For example, with the perimeter of the looped bundle, being, for example, about 36 inches as noted above, when the looped bundle 60 is hung from the hook 56 and pulled through the molding tube 58, the length from one end of the looped bundle 60 to the other end is about 18 inches. Preferably, when the looped bundle 60 is pulled through the molding tube 58, both curved ends of the looped bundle 60 extend outside of the molding tube 58. In this regard, the length of the molding tube 58 is preferably shorter than the length of the looped bundle 60 pulled through the molding tube 58 (e.g. about 17 inches long for an 18 inch long pulled fiber bundle).

Multiple molding tubes 58 (one per stick) are fixed to a rack which is held to a structure at the top of which sits an air-oil cylinder 54. Initially the cylinder 54 pushes a bar on which a dozen or so thin mold rods 55 are mounted. Each mold rod 55 is coupled to a hook 56 onto which a looped bundle 60 is supported. The cylinder 54 is then activated and the looped bundle 60 is drawn up though the molding tube 58 to a precalculated stop point. The stop point is calculated such that the curved parts 62 of looped bundle 60 are located just outside of the ends of the molding tube 58. At this point the filled tubular mold is ready for a curing step. Such curing may be performed in a suitable oven, at about 250° C. for 15–30 minutes at atmospheric pressure in air. The curing conditions may vary depending on the exact materials used.

The cured looped bundles may be removed from the tubes by means of power driven metal (preferably steel) rods or rams, each rod or ram being slightly smaller in diameter than the inner diameter of the molding tube 58. The rods are pushed through the molding tubes 58 to thereby push out the cured looped bundles. The ends of the cured looped bundle may then be cut to proper size.

With the curved ends 62 of the looped bundle 60 cut away, the remaining stick has unidirectional fibers extending along the length of the stick and substantially parallel to each other. Depending on the type of stick desired, the ends may be rounded or radiussed, the sticks tapered, and the tips ground from the drumstick or bonded to the drumstick. One minute exposure at 25° C. in air is generally adequate for a satisfactory bond between the tip and the stick, when using Permabond (trademark; available from Permabond International) as a bonding material. The bond improves with time at room temperature. The sticks are then marked with model and logo information.

Figure 7:
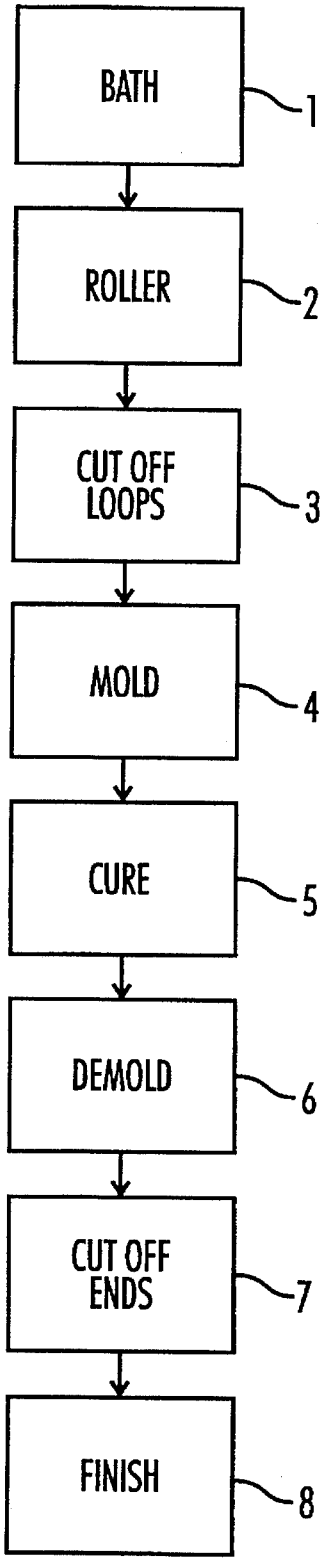
FIG. 7 is a flow chart showing steps in a method for manufacturing drumsticks according to certain embodiments of the present invention.

FIG. 7 shows a diagram outlining steps in a preferred method for manufacturing sticks. Step 1 involves drawing fiber through a bath containing resin. Step 2 involves winding the fiber into loops, using, for example, a roller. Step 3 involves cutting off the appropriate amount of fiber loops for making a stick. Step 4 involves placing the fiber loops into a mold. Step 5 involves the curing of the filled mold, preferably in an oven. Step 6 involves the removal of mold. Step 7 involves the cutting off of the looped ends of the fiber, and step 8 is the finishing of the stick, by, for example, sanding or grinding and either forming or attaching a tip to the stick.

Drumstick embodiments may contain varying ratios of resin to fiber to filler, depending on the desired type of stick and size. Sticks can be specifically tailored to a drummer's needs with regards to many properties, including weight, flexibility, hardness, appearance, and tonal quality to name a few. Preferred embodiments have weight percentages of 32 to 42% resin, 40 to 60% fibers, and up to 20% filler. Preferred volume percentages include 30 to 40% resin, 10 to 60% fibers, and up to 60% filler.

Embodiments of drumsticks according to the present invention provide numerous advantages over conventional wooden drumsticks. First, it is possible to produce sticks with minimal weight variance stick to stick. Preferably such variance is less than 1 gram. This means any two sticks in a model type will look, feel, and play substantially the same.

In preferred embodiments, responsiveness is similar to that of wood and tends to not vary from stick to stick as does wood. The sticks provide uniform balance and depending on the materials used and finish, feel like a wooden stick in the drummers hand. The sticks may also be fabricated to look like a variety of grained woods.

Longevity may be maximized due to the use of a composite which is stronger and more resistant to impact and to the elements (such as water & sweat) than wood. Additionally, the sticks may be manufactured at an affordable price. Finally, sticks according to preferred embodiments of the present invention produce sounds similar to those produced by wooden sticks.

The scope of the present invention is not limited to the specific embodiments discussed above. For example, mechanisms (hydraulic, pneumatic, gear operated, ball screw actuator-type linear actuator, or other mechanical device) other than an air-oil cylinder may be used to place the bundled fiber into a mold. In addition, the roller may contain less than or more than three posts for rolling the bundle. Alternatively, the fiber may be wound around a cylindrical or other shaped device.

What is claimed is:

1. A drumstick shaped body defining an elongated dimension and containing fibers; the body comprising:

a resin material coating said fibers;

wherein each fiber contained in the body extends along the elongated dimension of the body, the fibers distributed throughout a cross-section of the body, the cross-section being perpendicular to the elongated dimension of the body; and the body further comprising a filler material distributed throughout the perpendicular cross-section of the body.

2. A body as in claim 1, wherein the filler material is uniformly distributed throughout the resin and the body is solid throughout its volume.

3. A body as in claim 1, wherein the body contains no hollow interior portion therein.

4. A body as in claim 1, wherein the fibers comprise a plurality of strands.

5. A body a in claim 1, wherein the filler material comprises microspheres.

6. A drumstick as in claim 1, further comprising a colorant.

7. A drumstick as in claim 1, comprising by volume 30–40% resin material, 10–60% fibers, and up to 60% filler.

8. A drumstick as in claim 1, comprising by weight 32–42% resin material, 40–60% fibers, and up to 20% filler.

9. A drumstick shaped body defining an elongated dimension, the body comprising:

a resin material;

a plurality of fibers coated with the resin material, wherein each fiber of said plurality of fibers extends along the elongated dimension of the body, the fibers distributed throughout a cross-section of the body, the cross-section being perpendicular to the elongated dimension of the body; and a filler material distributed throughout the perpendicular cross-section of the body;

wherein the body has first and second ends, and wherein at least one fiber of said plurality of fibers extends continuously from the first end to the second end of the body.

10. A body as in claim 9, further comprising a tip attached to one of the first and second ends of the body.

11. A drumstick having a butt end portion, a tip portion, a straight portion between the butt end and tip portions, and a tapered portion between the straight and tip portions, the drumstick comprising:

a resin material;

a plurality of fibers, the fibers coated with the resin material, at least one of the plurality of fibers extending from the butt end portion through the straight portion and through the tapered portion to the tip portion; and a lightweight material distributed within the resin material.

12. A composite drumstick as in claim 11, wherein:

the lightweight material is uniformly distributed within the resin material;

said plurality of fibers are assembled into a bundle, and the drumstick contains no hollow portions therein.

13. An elongated drumstick shaped body containing fibers, the elongated drumstick shaped body comprising:

a resin material coating the fibers contained in the body;

wherein each fiber contained in the body extends along the elongated direction of the body; and the body further comprising a filler material distributed within the resin material;

wherein the body is solid throughout its volume.

14. A method for fabricating an elongated drumstick shaped body, the body containing fibers, each fiber contained in the body extending along the elongated direction of the body, comprising the steps of:

mixing a resin material and a filler material;

coating said fibers with the mixed resin material and filler material;

providing each fiber of the body in a length extending in the elongated direction of the body;

placing said lengths of the coated fibers into a generally tubular mold;

curing the coated fibers to form an elongated body having two end portions and fibers disposed throughout a cross-section of the body, the cross-section being perpendicular to elongated direction of the body; and removing the body from the mold.

15. A method as in claim 14, further comprising the steps of:

rolling the coated fibers around a roller to form a looped bundle of coated fibers:

removing a length of the looped bundle of coated fibers from the roller so that the looped bundle had two end portions having curved fiber and an intermediate portion having straight fiber;

placing the length of the looped bundle of coated fibers into the mold; and removing the curved fiber from at least one of the two end portions.

16. A method as in claim 15, wherein at least one of said fibers comprises a plurality of strands.

17. A method for fabricating a drumstick comprising the steps of:

drawing at least one fiber through an adhesive bath to wet the at least one fiber with resin;

wrapping the at least one fiber around a roller to form a length of rolled fiber;

removing the length of rolled fiber from the roller so that the length of rolled fiber has two longitudinal end portions having curved fiber and an intermediate portion having straight fiber;

placing the length of rolled fiber into a generally tubular mold; and curing the resin to form a solid drumstick.

18. A method as in claim 17, wherein said step of drawing at least one fiber through an adhesive bath comprises the step of mixing a filler material into the adhesive bath to form a uniform mixture of resin and filler material in the bath, said method further comprising the steps of:

removing the curved fiber from at least one of the two end portions of the rolled fiber;

tapering the cured length of rolled fiber; and incorporating a tip onto one end of the cured length of rolled fiber.

19. A method as in claim 17, wherein at least one of said fibers comprises a plurality of strands.

20. A method for fabricating a drumstick comprising the steps of:

drawing a plurality of fibers through an adhesive bath to wet the fibers with resin;

assembling the plurality of fibers into a fiber bundle;

wrapping the fiber bundle around a roller;

removing a length of the fiber bundle from the roller;

placing the length of fiber bundle into a generally tubular mold;

placing the filled tubular mold into a curing chamber and curing the resin to form a solid drumstick;

squeezing excess resin from the fiber bundle prior to wrapping the fiber bundle around the roller;

mounting the length of the fiber bundle on a hook;

attaching the hook to a pulling mechanism;

pulling the hook and length of fiber bundle into the tubular mold; and removing the cured drumstick from the tubular mold using a ram having a smaller diameter than the tubular mold.

21. A method as in claim 20, further comprising the step of removing the cured drumstick from the tubular mold by inserting a rod into the tubular mold.

22. A method for fabricating a drumstick body containing fibers having an elongated dimension, the method comprising the steps of:

providing a resin material;

mixing a filler material with the resin material to form a uniform mixture of filler material in the resin material;

coating the fibers with the uniform mixture;

assembling the fibers with the elongated dimension of each fiber of the body extending in the same direction;

placing the assembled and coated fibers into an elongated mold;

curing the resin material on the coated and assembled fibers in the mold, to form a solid, body having no hollow portions therein; and removing the cured body from the mold.

* * * * *